US005509661A

United States Patent [19]

Parsley

[11] Patent Number: 5,509,661

[45] Date of Patent: Apr. 23, 1996

[54] GEOMETRICAL SHAPE IDENTIFYING GAME

[76] Inventor: Ardith M. Parsley, 1549 Chillicothe St., Obetz, Ohio 43207

[21] Appl. No.: 371,860

[22] Filed: Jan. 12, 1995

[51] Int. Cl.[6] ..... A63F 3/00

[52] U.S. Cl. ..... 273/249

[58] Field of Search ..... 273/242, 243, 273/248, 249

[56] References Cited

U.S. PATENT DOCUMENTS

| | | | |
|---|---|---|---|
| 1,695,144 | 12/1928 | Edwards | 273/249 |
| 2,852,260 | 9/1958 | Caffrey | 273/249 |
| 3,104,106 | 9/1963 | Kenney | 273/249 X |
| 3,815,919 | 6/1974 | Cain | 273/249 |
| 5,167,503 | 12/1992 | Jordan | 273/249 X |
| 5,249,808 | 10/1993 | Batte | 273/249 |
| 5,277,429 | 1/1994 | Smith | 273/249 X |
| 5,350,179 | 9/1994 | Hill | 273/249 |
| 5,388,835 | 2/1995 | Albright | 273/249 |

*Primary Examiner*—William E. Stoll

[57] ABSTRACT

A game for entertaining and educating players on various geometrical shapes. The inventive game includes a game board having a plurality of geometrical shapes printed thereon. A deck of cards, each having an individual one of the geometrical shapes printed thereon, is provided for random selection by each player. The players advance game tokens along the board in accordance with the random cards to win a game by advancing to a finish area of the board.

3 Claims, 4 Drawing Sheets

GEOMETRICAL SHAPE IDENTIFYING GAME

BACKGROUND OF THE INVENTION

1. Field of the Invention

The present invention relates to board games and more particularly pertains to an geometrical shape identifying game for entertaining and educating players on various geometrical shapes.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 5,090,707; U.S. Pat. No. 5,052,692; U.S. Pat. No. 5,037,111; U.S. Pat. No. 4,078,803; and U.S. Pat. No. 3,955,534.

While these devices fulfill their respective, particular objectives and requirements, the aforementioned patents do not disclose a geometrical shape identifying game for entertaining and educating players on various geometrical shapes which includes a game board having a plurality of geometrical shapes printed thereon, and a deck of cards each having an individual one of the geometrical shapes printed thereon for random selection by each player, wherein the players advance game tokens along the board in accordance with the random cards to win the game by advancing to a finish area of the board.

In these respects, the geometrical shape identifying game according to the present invention substantially departs from the conventional concepts and designs of the prior art, and in so doing provides an apparatus primarily developed for the purpose of entertaining and educating players on various geometrical shapes.

SUMMARY OF THE INVENTION

In view of the foregoing disadvantages inherent in the known types of board games now present in the prior art, the present invention provides a new geometrical shape identifying game construction wherein the same can be utilized for entertaining and educating players of the game. As such, the general purpose of the present invention, which will be described subsequently in greater detail, is to provide a new geometrical shape identifying game apparatus and method which has many of the advantages of the board games mentioned heretofore and many novel features that result in a geometrical shape identifying game which is not anticipated, rendered obvious, suggested, or even implied by any of the prior art board games, either alone or in any combination thereof.

To attain this, the present invention generally comprises a game for entertaining and educating players on various geometrical shapes. The inventive game includes a game board having a plurality of geometrical shapes printed thereon. A deck of cards, each having an individual one of the geometrical shapes printed thereon, is provided for random selection by each player. The players advance game tokens along the board in accordance with the random cards to win a game by advancing to a finish area of the board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new geometrical shape identifying game apparatus and method which has many of the advantages of the board games mentioned heretofore and many novel features that result in a geometrical shape identifying game which is not anticipated, rendered obvious, suggested, or even implied by any of the prior art board games, either alone or in any combination thereof.

It is another object of the present invention to provide a new geometrical shape identifying game which may be easily and efficiently manufactured and marketed.

It is a further object of the present invention to provide a new geometrical shape identifying game which is of a durable and reliable construction.

An even further object of the present invention is to provide a new geometrical shape identifying game which is susceptible of a low cost of manufacture with regard to both materials and labor, and which accordingly is then susceptible of low prices of sale to the consuming public, thereby making such geometrical shape identifying games economically available to the buying public.

Still yet another object of the present invention is to provide a new geometrical shape identifying game which provides in the apparatuses and methods of the prior art some of the advantages thereof, while simultaneously overcoming some of the disadvantages normally associated therewith.

Still another object of the present invention is to provide a new geometrical shape identifying game for entertaining and educating players on various geometrical shapes.

Yet another object of the present invention is to provide a new geometrical shape identifying game includes a game board having a plurality of geometrical shapes printed thereon, and a deck of cards each having an individual one of the geometrical shapes printed thereon for random selection by each player, wherein the players advance game tokens along the board in accordance with the random cards to win the game by advancing to a finish area of the board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
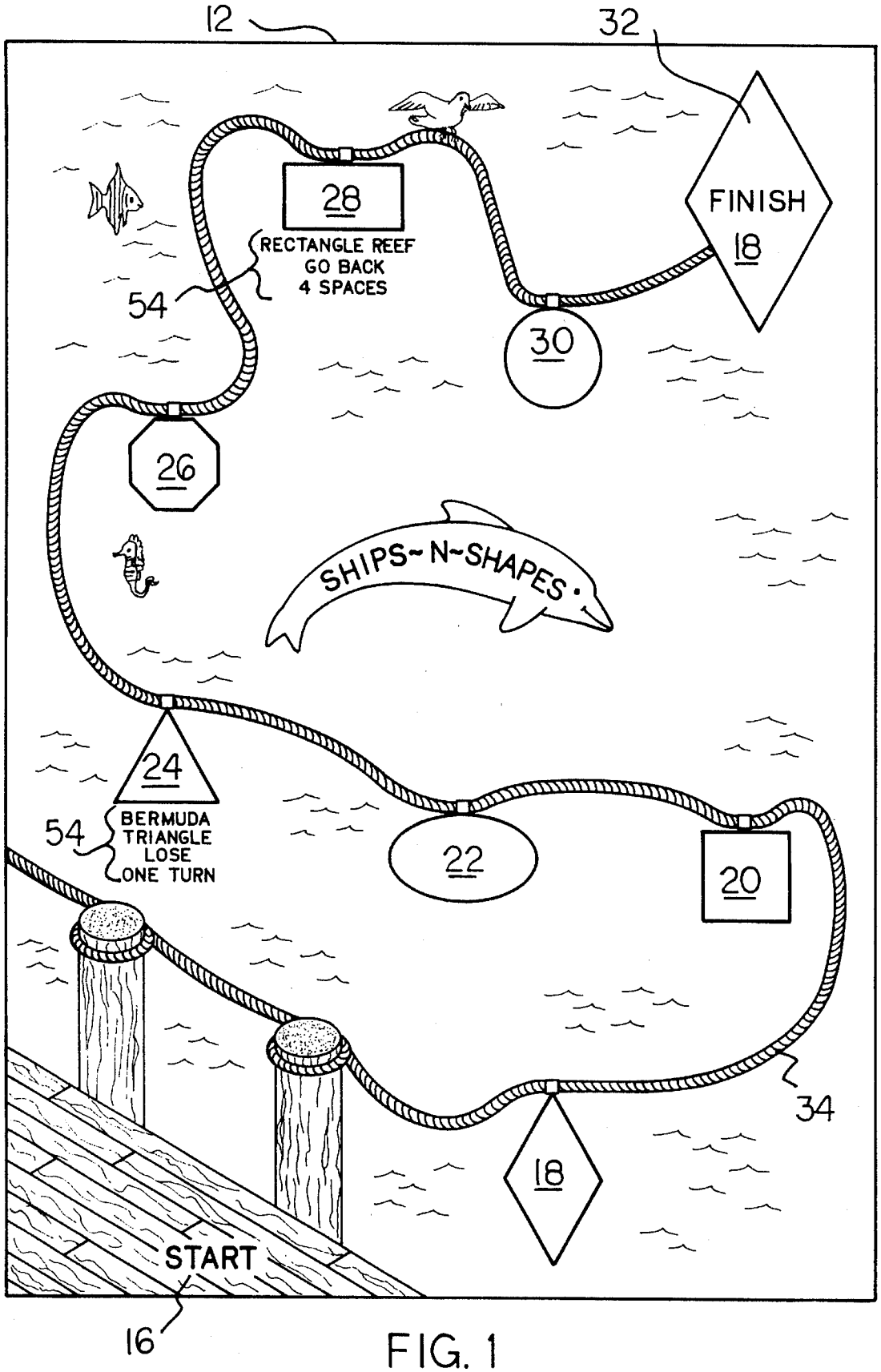
FIG. 1 is a plan view of a game board comprising a portion of the present invention.

With reference now to the drawings, and in particular to FIGS. 1–7 thereof, a new geometrical shape identifying game embodying the principles and concepts of the present invention and generally designated by the reference numeral 10 will be described.

Figure 2:
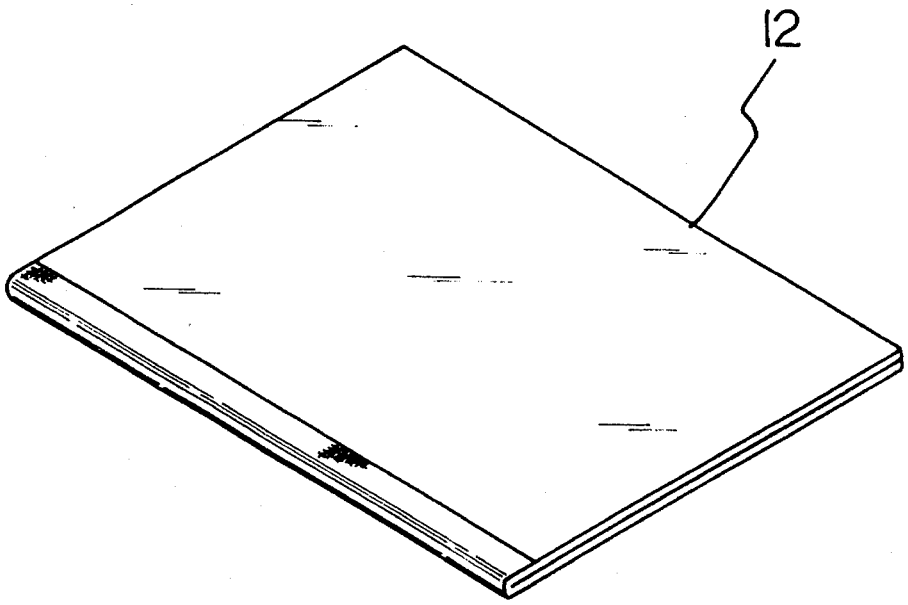
FIG. 2 is an isometric illustration of the game board in a folded configuration.
Figure 3:
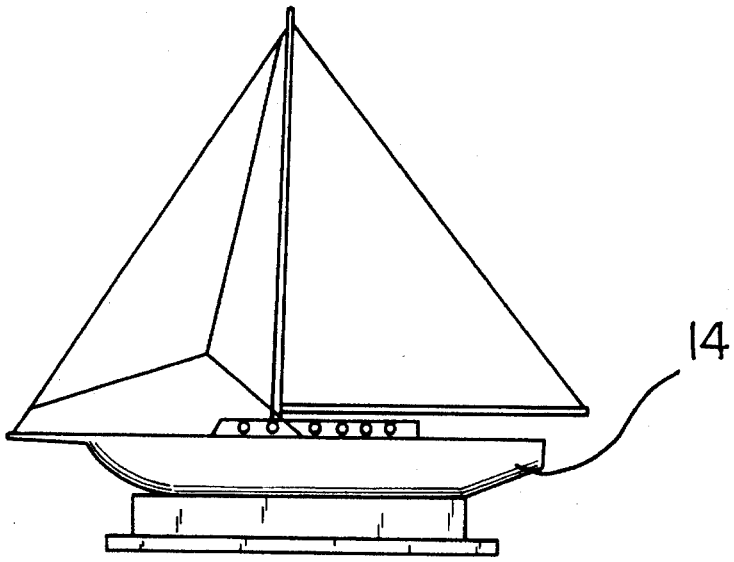
FIG. 3 is a side elevation view of a game token of the invention.

More specifically, it will be noted that the geometrical shape identifying game 10 comprises a game board 12 having a plurality of areas printed thereon within which a game token 14, as shown in FIG. 3, can be selectively positioned by a player during play of the game 10. The areas of the game board 12 are shaped so as to resemble various geometrical shapes and include a starting area 16, a diamond shaped area 18, a square shaped area 20, an oval shaped area 22, a triangle shaped area 24, an octagon shaped area 26, a rectangle shaped area 28, a circle shaped 30, and a finish area 32. The starting area 16 is connected to the geometrical shape areas 18–30 and to the finish area 32 by a guideline 34 extending sequentially between the areas. Preferably the guideline 34 is shaped so as to resemble a rope connecting the geometrical shapes together. The game board 12, as shown in FIG. 2, is preferably provided with an unlabeled fold line permitting a collapsing thereof into the compact configuration for storage and/or traveling purposes.

Figure 4:
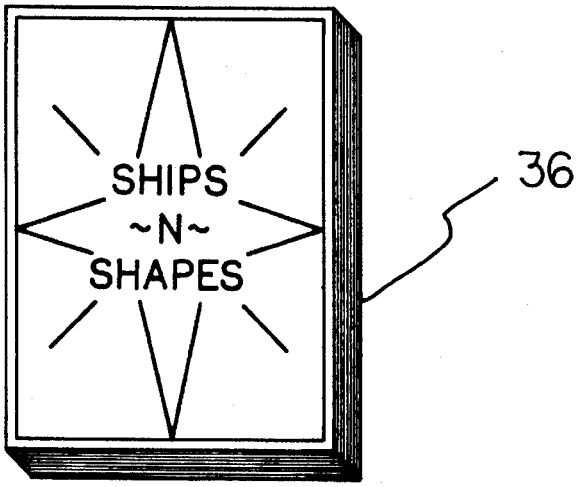
FIG. 4 is an isometric illustration of a deck of cards of the invention.
Figure 5:
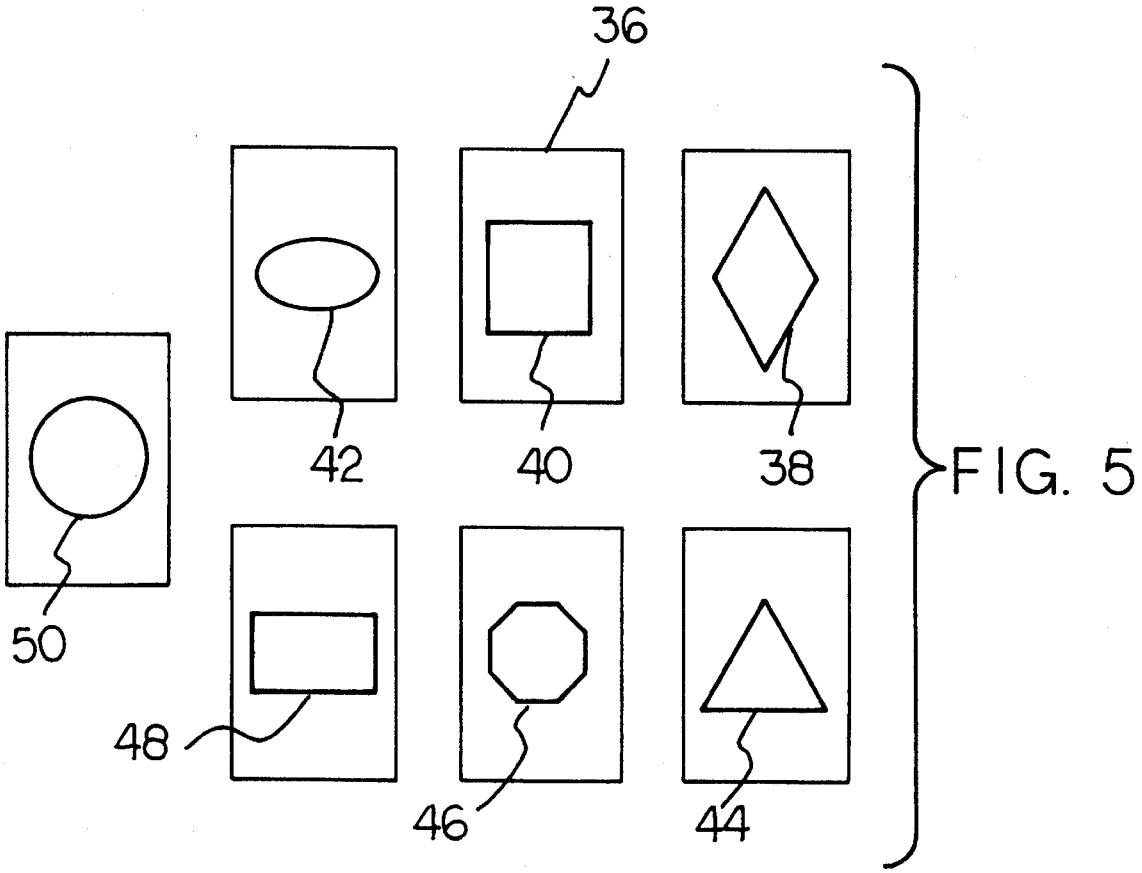
FIG. 5 is a plan view of a plurality of the cards.

Referring now to FIGS. 4 and 5 it can be shown that a deck of cards 36 is provided for use with the present invention 10. As shown in FIG. 5, the cards include a shape printed thereon corresponding to one of the shaped areas 18–32 of the game board 12. To this end, the cards include a diamond shape 38, a square shape 40, an oval shape 42, a triangle shape 44, an octagon shape 46, a rectangle shape 48, and a circle shape 50. Thus, as individual player draws one of the cards 36 from the deck thereof, the player will advance the game token 14 to the correspondingly shaped area 18–32 only if such corresponding area is the next adjacent area along the guideline 34. In other words, a player residing within the starting area 16 can only advance to the diamond shaped area 18 through the drawing of a card 36 having the diamond shape 38 printed thereon. The player can then next move to the square shaped area 20 only by drawing a card 36 having the square shape 40 thereon. Cards 36 drawn which do not correspond to the next adjacent shaped area 18–32 are simply placed aside or onto a bottom of the deck of cards 36. If desired, the game can be played such that each player can advance both towards or away from the finish area by drawings cards corresponding to adjacent shaped areas residing either towards or away from the finish area. By this structure, the deck of cards 36 can be randomly shuffled, wherein opposing players attempt to advance along the guideline 34 to the finish area 32 by drawing cards having the corresponding shape 38–50 printed thereon. The finish area 32 may comprise any one of the shaped areas 18–30, but preferably comprises the diamond shaped area 18 substantially as shown in FIG. 1. A winner of the game is thus the first player to land in the finish area 32.

Figure 6:
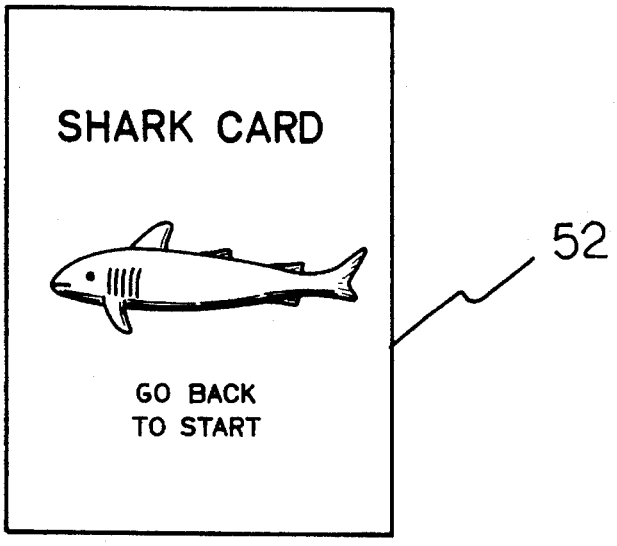
FIG. 6 is a plan view of a single shark card.
Figure 7:
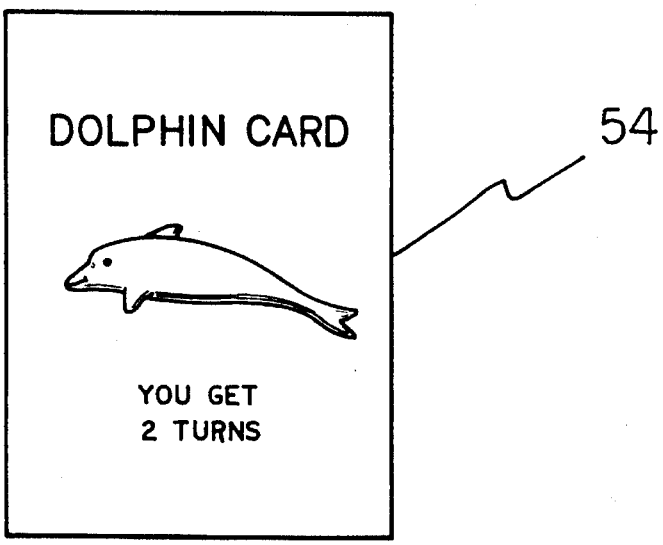
FIG. 7 is a plan view of a single dolphin card.

As shown in FIGS. 6 and 7, the cards 36 may further include a demotion card 52 instructing the player drawing such demotion card to return to the starting area 16. As shown in FIG. 7, the deck of cards may also include a promotion card 54 entitling a player to get two draws from the deck of cards 36. Further, and as shown in Figure instructional indica 54 can be printed proximal to one of the shaped areas 18–30 to further guide the game tokens 14 along the guideline 34. For example, all players landing on the triangle shaped area 24, as shown by the instructional indica 54 printed therebelow, will lose one turn wherein such players not permitted to draw from the deck of cards 36 during that turn of play. Further, all players landing on the rectangle shaped area 28 for the first time can be instructed by the instructional indica 54 to go back a total of four spaces, i.e. to the square shaped area 20. Thus, the instructional indica 54 substantially complicates play of the game by effectively elongating the total number of shaped areas 18–30 which must be drawn from the deck of cards 36 during play of the game.

An alternative method of playing the game 10 can comprise moving the players game token 14 to whichever shaped area 18–30 is drawn from a first initial draw from the deck of cards 36. In this method of play of the game 10, the game is substantially shorter in duration inasmuch as a player can advance over a substantial number of areas during the initial draw of the cards 36. The geometrical shape identifying game 20 according to the present invention can thus be easily utilized for entertaining and educating players on various geometrical shapes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a game comprising the steps of:

(a) providing a geometrical shape identifying game comprising a game board having a plurality of areas printed thereon within which a game token can be selectively positioned by a player, the areas of the game board being shaped so as to define various geometrical shapes and include a starting area and a finish area, with the various geometrical shapes being serially oriented between the starting and finish areas, the geometrical shapes including a diamond shaped area, a square shaped area, an oval shaped area, a triangle shaped area, an octagon shaped area, a rectangle shaped area, and a circle shaped area, with the starting area being connected to the geometrical shaped areas and to the finish area by a guideline extending sequentially between the areas; and a deck of cards, the cards each including a shape printed thereon corresponding to one of the shaped areas of the game board;

(b) providing a game token;

(c) drawing one of the cards from the deck thereof;

(d) positioning the game token on a correspondingly shaped area of the game board relative to the one of the card drawn from the deck, wherein the correspondingly shaped area of the game board must be adjacent to an area upon which the game token is residing.

2. The method of playing a game of Claim 1, and further comprising the steps of:

(e) drawing another one of the cards from the deck thereof;

(f) positioning the game token on a correspondingly shaped area of the game board relative to the another one of the cards drawn from the deck only when the correspondingly shaped area is adjacent to an area upon which the game token is residing.

3. The method of playing a game of Claim 2, wherein step (f) comprises:

positioning the game token on a correspondingly shaped area of the game board relative to the another one of the cards drawn from the deck only when the correspondingly shaped area is adjacent to an area upon which the game token is residing and only when the correspondingly shaped area is sequentially closer to the finish area than the area upon which the game token is residing;

and, positioning the game token on a correspondingly shaped area of the game board relative to the another one of the cards drawn from the deck only when the correspondingly shaped area is adjacent to an area upon which the game token is residing and only when the correspondingly shaped area is sequentially farther from the finish area than the area upon which the game token is residing.

* * * * *